US008960962B2

(12) United States Patent
McCane et al.

(10) Patent No.: US 8,960,962 B2
(45) Date of Patent: Feb. 24, 2015

(54) CEILING MOUNT FIXTURE

(71) Applicant: ABL IP Holding LLC, Conyers, GA (US)

(72) Inventors: Stephen Barry McCane, McDonough, GA (US); John T. Mayfield, III, Loganville, GA (US); Russell Vern Rouse, Oxford, GA (US)

(73) Assignee: ABL IP Holding LLC, Conyers, GA (US)

( * ) Notice: Subject to any disclaimer, the term of this patent is extended or adjusted under 35 U.S.C. 154(b) by 36 days.

(21) Appl. No.: 13/833,201

(22) Filed: Mar. 15, 2013

(65) Prior Publication Data

US 2014/0104843 A1 Apr. 17, 2014

Related U.S. Application Data

(60) Provisional application No. 61/708,272, filed on Oct. 1, 2012.

(51) Int. Cl.

| | |
|---|---|
| ***F21V 17/02*** | (2006.01) |
| ***F21V 21/03*** | (2006.01) |
| ***F21V 3/04*** | (2006.01) |
| ***F21V 15/015*** | (2006.01) |
| ***F21V 19/00*** | (2006.01) |
| *F21V 3/02* | (2006.01) |
| *F21Y 101/02* | (2006.01) |
| *F21Y 111/00* | (2006.01) |

(52) U.S. Cl.

CPC ..... *F21V 17/02* (2013.01); *F21V 21/03* (2013.01); *F21V 3/0445* (2013.01); *F21V 15/015* (2013.01); *F21V 19/003* (2013.01); *F21V 3/02* (2013.01); *F21Y 2101/02* (2013.01); *F21Y 2111/005* (2013.01)

USPC ..... 362/282; 362/217.1; 362/249.02

(58) Field of Classification Search

CPC .... F21Y 2111/005; F21V 21/02; F21V 21/03

USPC ..... 362/282, 218, 217.1, 217.08, 249.02

See application file for complete search history.

(56) References Cited

U.S. PATENT DOCUMENTS

| | | | |
|---|---|---|---|
| 2,291,488 | A | 7/1942 | Naysmith |
| 2,331,811 | A | 10/1943 | Sprecher |
| 2,338,077 | A | 12/1943 | Scribner |
| 2,523,840 | A | 9/1950 | Nitardy |
| 2,525,537 | A | 10/1950 | Fletcher |
| 2,525,556 | A | 10/1950 | Marchisio |
| 2,570,910 | A | 10/1951 | Berry |
| 2,645,708 | A | 7/1953 | Marchisio |

(Continued)

*Primary Examiner* — Anne Hines

(74) *Attorney, Agent, or Firm* — Kilpatrick Townsend & Stockton, LLP

(57) ABSTRACT

A ceiling mount lighting fixture includes a channel, a channel cover, and a light source including a plurality of light-emitting diodes. The channel cover includes two sides that intersect in a V-shaped base, with light-emitting diodes mounted on each side. The light-emitting diodes emit light at cone angles that overlap at the base of the channel cover. The fixture may include a diffuser and an end cap positioned on each end of the channel, each end cap including a groove. A plurality of strips may be located on the diffuser, each strip moveable from a first position on the diffuser a distance from the end caps to a second position in which the strip engages the groove on one of the end caps, thereby serving as a light trap to block light from exiting gaps between the diffuser and end caps.

17 Claims, 13 Drawing Sheets

(56) References Cited

U.S. PATENT DOCUMENTS

| | | | |
|---|---|---|---|
| 2,659,811 | A | 11/1953 | Wakefield |
| 2,902,591 | A | 9/1959 | Lipscomb |
| 2,978,573 | A | 4/1961 | Kalbrunner |
| 3,025,391 | A | 3/1962 | Golko |
| 3,060,309 | A | 10/1962 | Ogden et al. |
| 3,065,343 | A | 11/1962 | Zurawski |
| 3,070,689 | A | 12/1962 | McIntosh |
| 3,132,813 | A | 5/1964 | Izzi et al. |
| 3,159,352 | A | 12/1964 | Wakefield et al. |
| 3,185,835 | A | 5/1965 | Muller et al. |
| 3,209,142 | A | 9/1965 | Michel et al. |
| 3,397,308 | A | 8/1968 | Wakefield et al. |
| 3,549,879 | A | 12/1970 | Meyer |
| 3,860,829 | A | 1/1975 | Fabbri |
| 4,698,733 | A | 10/1987 | Griffin |
| 4,907,138 | A | 3/1990 | Brueggemann et al. |
| 5,088,015 | A | 2/1992 | Baggio et al. |
| 5,124,896 | A | 6/1992 | Bentley |
| 5,171,085 | A | 12/1992 | Jaksich |
| 5,440,466 | A | 8/1995 | Belisle et al. |
| 5,479,327 | A | 12/1995 | Chen |
| 5,508,902 | A | 4/1996 | Shoemaker |
| 5,791,764 | A | 8/1998 | Jaksich |
| 5,906,427 | A | 5/1999 | Noh |
| 6,135,620 | A | 10/2000 | Marsh |
| 6,505,953 | B1 | 1/2003 | Dahlen |
| 6,523,975 | B1 | 2/2003 | Plourde et al. |
| 6,568,830 | B2 | 5/2003 | Yaphe et al. |
| 6,619,815 | B2 | 9/2003 | Southern, Jr. |
| 6,793,381 | B2 | 9/2004 | Marsh |
| 6,796,676 | B2 | 9/2004 | Severtson et al. |
| 6,837,592 | B1 | 1/2005 | Dahlen |
| 6,984,055 | B2 | 1/2006 | McCarthy et al. |
| 7,029,143 | B2 | 4/2006 | Kiechle et al. |
| 7,036,955 | B2 | 5/2006 | Kazi et al. |
| 7,055,982 | B2 | 6/2006 | Yaphe et al. |
| 7,080,923 | B2 | 7/2006 | Plunk et al. |
| 7,129,625 | B2 | 10/2006 | Marsh |
| 7,144,129 | B2 | 12/2006 | Mackin |
| 7,261,435 | B2 | 8/2007 | Gould et al. |
| 7,296,911 | B2 | 11/2007 | Plunk et al. |
| 7,314,295 | B2 | 1/2008 | Legat et al. |
| 7,338,182 | B1 | 3/2008 | Hastings et al. |
| 7,341,359 | B2 | 3/2008 | Hwang et al. |
| 7,384,170 | B2 | 6/2008 | Skegin |
| 7,438,432 | B2 | 10/2008 | Yaphe et al. |
| 7,494,241 | B2 | 2/2009 | McCarthy et al. |
| 7,513,639 | B2 | 4/2009 | Wang |
| 7,530,716 | B2 | 5/2009 | Mayfield, III et al. |
| 7,585,088 | B2 | 9/2009 | Tyson |
| 7,588,345 | B1 | 9/2009 | Davis et al. |
| 7,674,005 | B2 | 3/2010 | Chung et al. |
| 7,758,207 | B1 | 7/2010 | Zhou et al. |
| 7,828,468 | B2 | 11/2010 | Mayfield, III et al. |
| 7,963,662 | B2 | 6/2011 | Chung et al. |
| 2009/0141507 | A1 | 6/2009 | Compton et al. |
| 2009/0323342 | A1* | 12/2009 | Liu ..... 362/249.02 |
| 2011/0211343 | A1 | 9/2011 | Chung et al. |

* cited by examiner

CEILING MOUNT FIXTURE

RELATED APPLICATION

This application claims the benefit of U.S. Provisional application No. 61/708,272, filed Oct. 1, 2012, entitled "Ceiling mount fixture," the disclosure of which is hereby incorporated by reference in its entirety.

FIELD OF THE INVENTION

The present invention relates to light fixtures, and in particular to ceiling mount fixtures for light-emitting diode ("LED"), fluorescent or other luminaires.

BACKGROUND

Ceiling mount lighting fixtures for use in LED, fluorescent and other lighting applications are known. In a typical configuration, a ceiling mount fixture includes a channel, a channel cover, a light source (e.g., fluorescent bulbs or LEDs), a diffuser and end caps. In ceiling mount fixtures, the channel is mounted on the ceiling. The channel cover is positioned within the channel, and a power source (such as a ballast for a fluorescent light) and wiring is contained between the channel and the channel cover. In a traditional fluorescent ceiling mount fixture, fluorescent lamps are mounted on lamp sockets located at each end of the fixture so as to extend along the length of the fixture. A diffuser is positioned over the channel, and light from the light source passes through the diffuser and into the area to be illuminated. End caps are provided to enclose the ends of the fixture and impart a polished appearance to it.

There continues to be a need to facilitate assembly of and access to the various components of these light fixtures as well as better capture and distribution of the light emitted by the light sources in these fixtures.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

In one embodiment, a ceiling mount lighting fixture includes a channel, a channel cover and a light source including a plurality of light-emitting diodes. The channel includes a first side and a second side that intersect in a V-shaped base, wherein at least one of the plurality of light-emitting diodes is mounted on the first side of the channel cover and at least another of the plurality of light-emitting diodes is mounted on the second side of the channel cover. The plurality of light-emitting diodes mounted on the channel cover emit light at cone angles that overlap at the base of the channel cover.

In an embodiment, the plurality of light-emitting diodes emit light at a cone angle of approximately 120 degrees.

In certain embodiments, the V-shaped base includes an internal angle defined by an angle between the first side and second side, and the internal angle is from about 170 to about 100 degrees. In other embodiments, the internal angle is from about 150 degrees to about 140 degrees.

In some embodiments, the ceiling mount fixture includes a diffuser having a first diffuser end plate located on a first end of the diffuser and a second diffuser end plate located on a second end of the diffuser opposite the first end, and a first end cap mounted on a first end of the channel and a second end cap mounted on a second end of the channel opposite the first end. One of the first diffuser end plate and the first end cap includes at least one pin and the other of the first diffuser end plate and the first end cap includes at least one hook-like structure that engages the at least one pin of the one of the first diffuser end plate and the first end cap.

In other embodiments one of the second diffuser end plate and the second end cap includes at least one pin and the other of the second diffuser end plate and the second end cap includes at least one hook-like structure that engages the at least one pin of the one of the second diffuser end plate and the second end cap.

In yet other embodiments, a diffuser includes a first diffuser end plate located on a first end of the diffuser, a second diffuser end plate located on a second end of the diffuser opposite the first end, a first end cap mounted on a first end of the channel and a second end cap mounted on a second end of the channel opposite the first end. The first diffuser end plate includes a first hook-like structure, the second diffuser end plate includes a second hook-like structure, the first end cap includes a first pin and the second end cap includes a second pin. The first pin on the first end cap engages the first hook-like structure on the first diffuser end plate, and the second pin on the second end cap engages the second hook-like structure on the second diffuser end plate, such that the diffuser is retained by the channel and rotatable about the first pin and second pin.

In some embodiments, one of the channel cover and channel includes at least one tab extending therefrom, wherein the tab comprises a distal portion and a proximal portion narrower than the distal portion, and the other of the channel and channel cover includes at least one T-slot for receiving the tab, wherein the T-slot comprises a wider portion and a narrower portion. The tab is movable within the T-slot from a first position in which the distal portion of the tab may pass through the wider portion of the T-slot to a second position in which the tab is retained in the T-slot by the narrower portion of the T-slot, such that the channel cover is retained by the channel.

In an embodiment, a ceiling mount lighting fixture includes a channel having two ends, a light source, a diffuser, an end cap positioned on each end of the channel, wherein each end cap includes a groove, and a plurality of strips located on the diffuser, each strip moveable from a first position on the diffuser a distance from the end caps to a second position in which the strip engages the groove on one of the end caps.

In some embodiments, methods are described for assembling the fixture, and in particular for installing the channel cover over the channel, for installing the diffuser and diffuser end plates to the channel and end caps, and for installing the strips over gaps between the diffuser and diffuser end plates.

BRIEF DESCRIPTION OF THE DRAWINGS

Illustrative embodiments of the present invention are described in detail below with reference to the following drawing figures.

DETAILED DESCRIPTION

Figure 1:
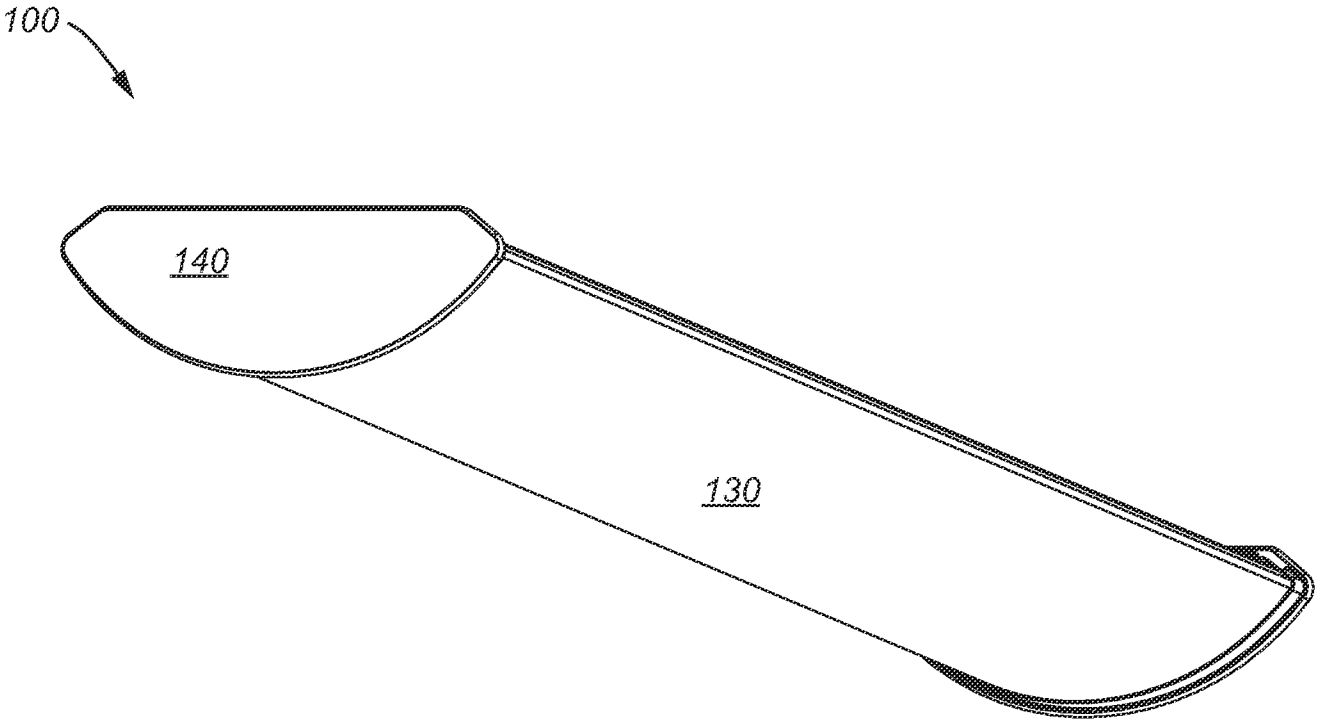
FIG. 1 is a bottom perspective view of one embodiment of a light fixture.
Figure 2:
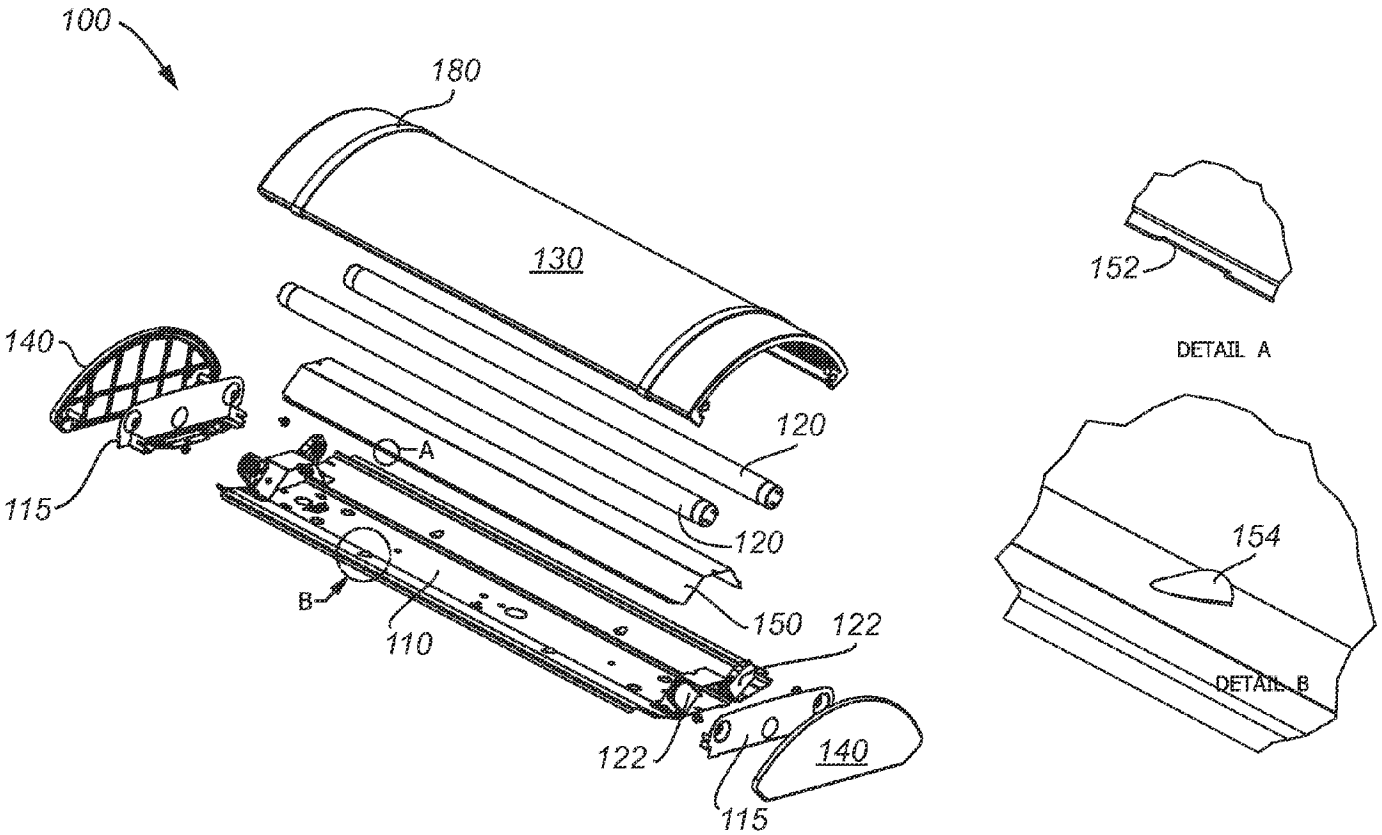
FIG. 2 is an exploded view of a fluorescent light fixture according to one embodiment with Detail A and Detail B showing features of the invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

With reference to FIGS. 1-5, embodiments of the present invention include a ceiling mount fixture 100 having a channel 110, a channel cover 150 mounted to the channel 110, a light source such as a plurality of fluorescent lamps 120 (see FIG. 2) or a plurality of LEDs 125 (see FIG. 3), a diffuser 130 and end caps 140. While embodiments of the invention are described as including fluorescent lamps 120 and LEDs 125, other light sources are also contemplated herein. In ceiling mount fixtures, the channel 110 is mounted on the ceiling, although it is certainly contemplated that such would not always be the case. The channel cover 150 is positioned over the channel 110 so that a power source such as a ballast for a fluorescent bulb or a driver for LEDs and associated wiring (not shown) are contained between the channel 110 and the channel cover 150. As shown in Detail A and Detail B of FIG. 2, the channel cover 150 may include a plurality of notches 152 that engage a plurality of humps 154 on the channel 110 so as to facilitate alignment of the channel 110 over the channel cover.

The channel 110, channel cover 150 and end caps 140 may independently be formed from known lighting fixture materials, including but not limited to aluminum, steel, non-ferrous metal and polymeric materials.

Figure 3:
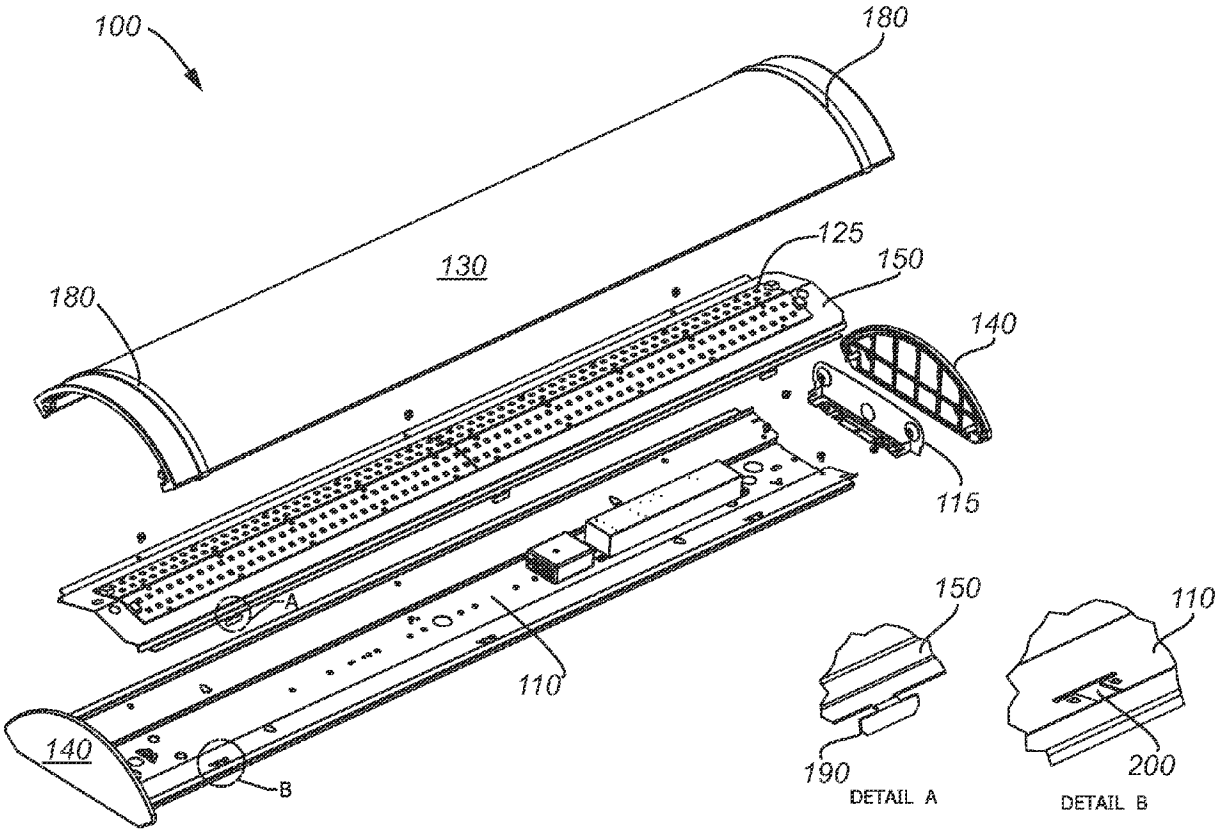
FIG. 3 is an exploded view of an LED light fixture according to one embodiment, with Detail A and Detail B showing certain features of the invention.
Figure 4:
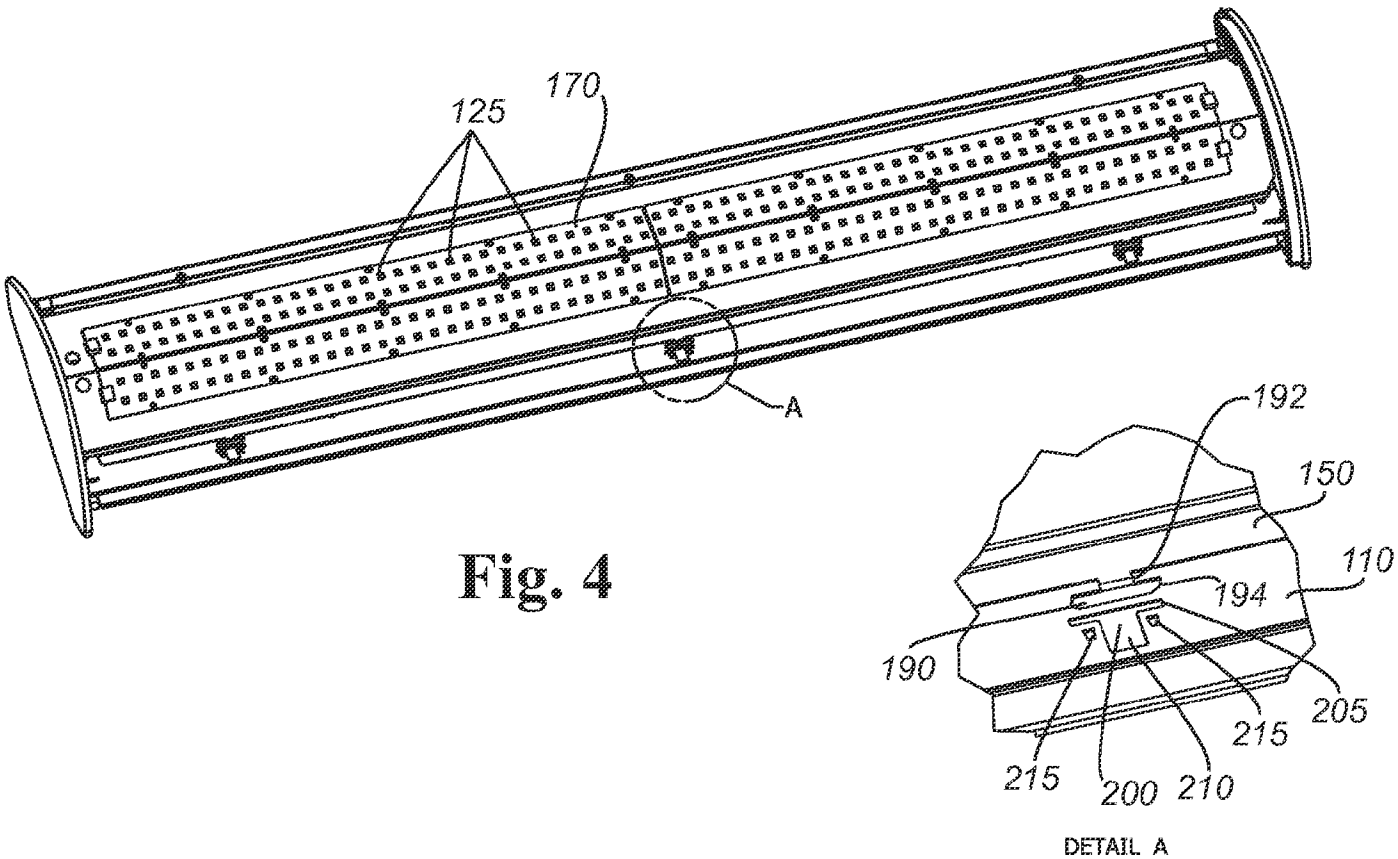
FIG. 4 is bottom perspective view of an embodiment according to FIG. 3 with Detail A showing certain features of the invention.
Figure 5:
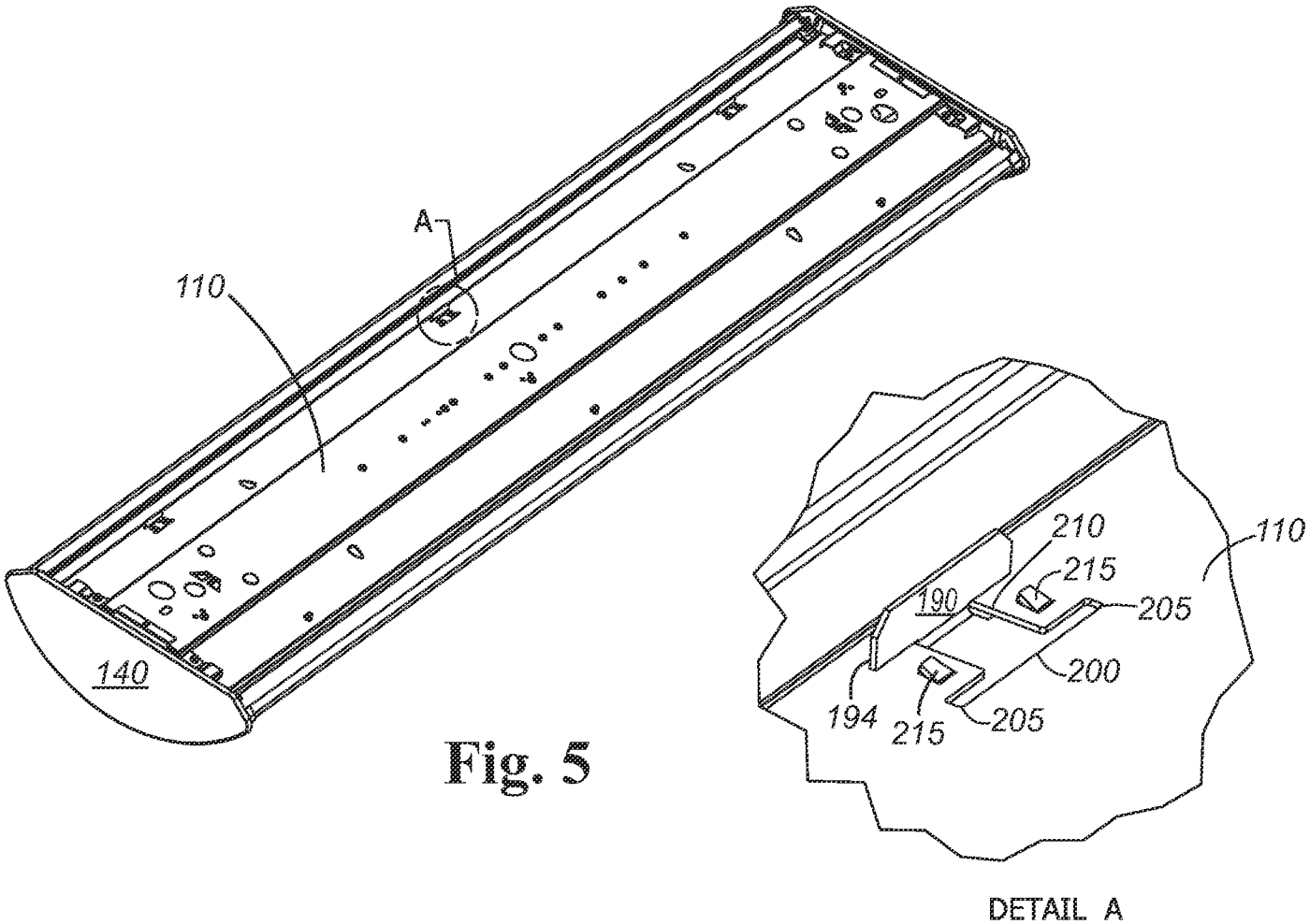
FIG. 5 is a top perspective view of an embodiment with Detail A showing certain features of the invention.

In one embodiment, the channel cover 150 is positioned and retained on the channel 110 through the use of a notched tab. With reference to FIG. 3 (Detail A and Detail B), FIG. 4 (Detail A) and FIG. 5 (Detail A), in certain embodiments, at least one notched tab 190 extends from one side of the channel cover 150 and a corresponding T-slot 200 is provided in the sides of the channel 110. The T-slot 200 has a wider part 205 and a narrower part 210 (which is narrower than the wider part 205). The at least one tab 190 is notched such that the portion of the tab closest (proximal) the channel cover (denoted as proximal portion 192) is narrower than the portion of the tab distal from the channel cover (denoted as distal portion 194). The distal portion 194 of the tab 190 engages the wider part 205 of the T-slot 200. Once the tab 190 is inserted into the T-slot 200 it is pushed back along the narrower part 210 of the T-slot 200 so that it cannot disengage from the T-slot 200. The width of the proximal portion 192 of the tab 190 may be approximately the same, or less than, the width of the narrower part 210 of the T-slot 200. The width of the distal portion 194 of the tab 190 may be approximately the same, or less than, the width of the wider part 205 of the T-slot 200. It will be recognized, however, that the width of the distal portion 194 of the tab 190 should be greater than the width of the narrower part 210 of the T-slot 200, or the tab 190 can disengage from the T-slot 200.

Lances 215 may be provided in the channel 110 to retain the tab 190 within the narrower part 210 of the T-slot 200 and thereby prevent the tab 190 from moving back towards the wider part 205 of the T-slot 200 where it could disengage from the channel 110. Once the at least one tab 190 is positioned in the T-slot 200, the channel cover 150 is rotated to cover the channel 110. The other side of the channel cover 150 may be secured to the channel 110 with screws or another type of fastener.

It will be recognized that the tab 190 need not necessarily be located on the channel cover 150 with the T-slot 200 located on the channel 110. Thus, in certain embodiments (not shown), the T-slot 200 is located on the channel cover 150 and the tab 190 is located on the channel 110. The tab 190 engages the T-slot 200 as described above.

Figure 6:
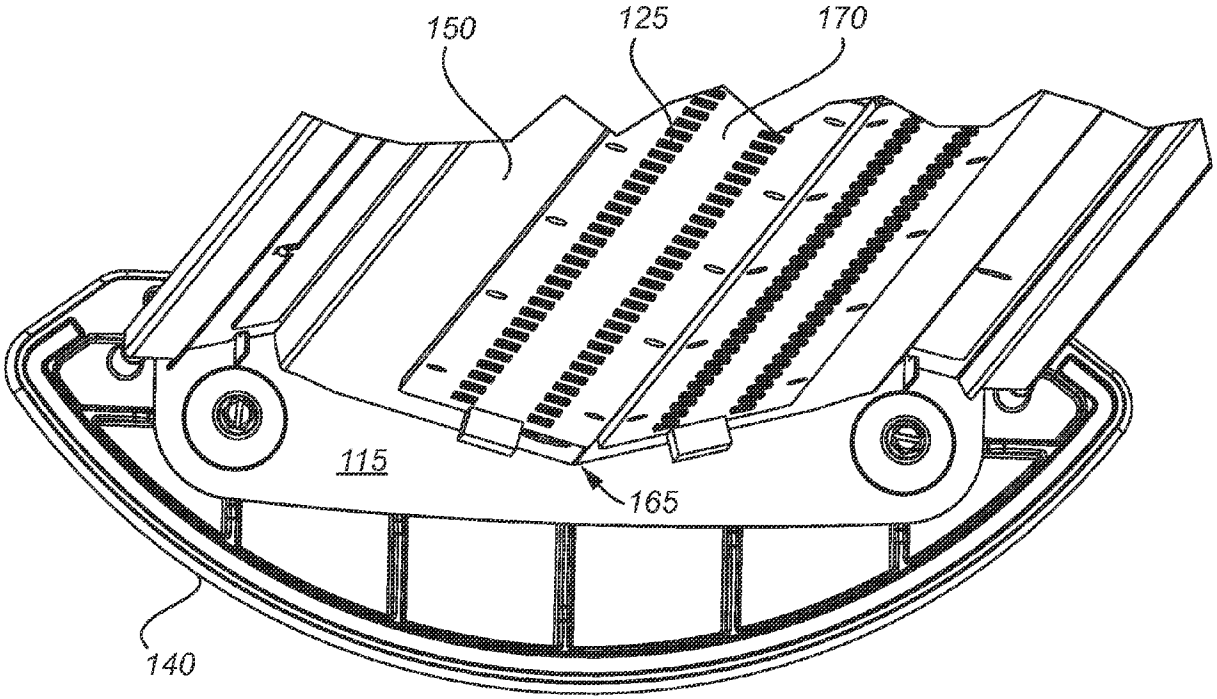
FIG. 6 is partial bottom perspective view of one embodiment of the invention.
Figure 7:
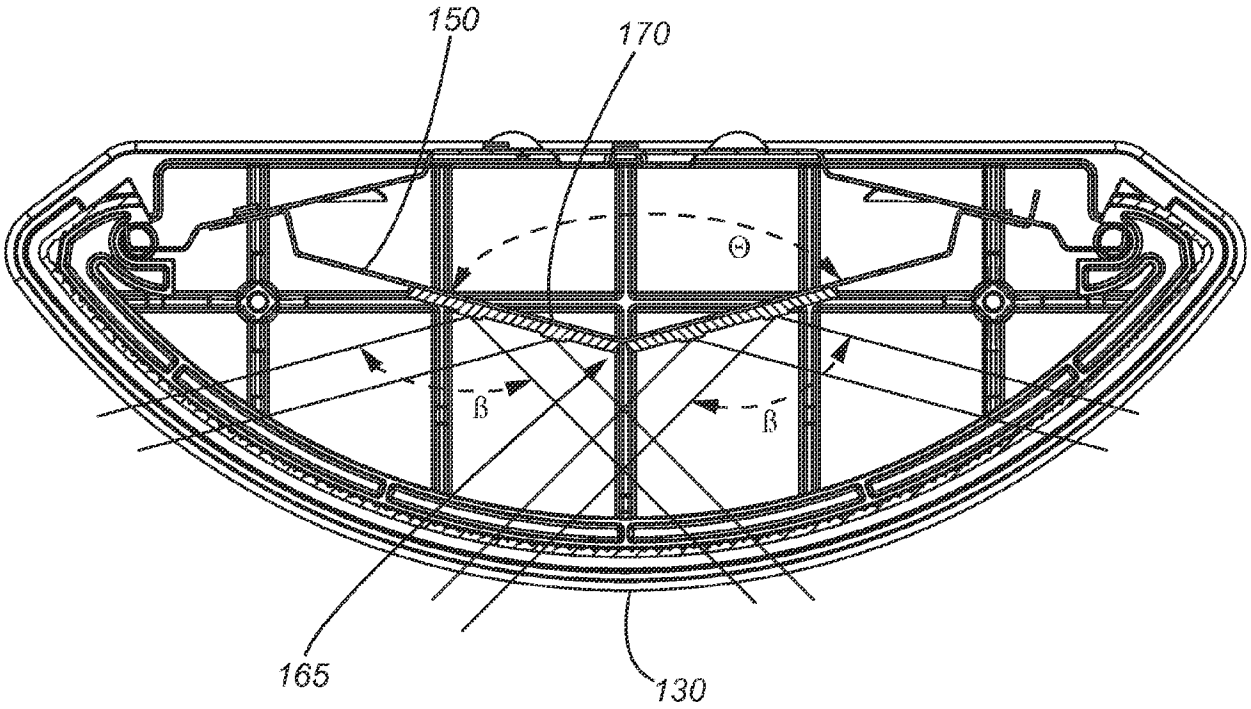
FIG. 7 is an end cross-section view of an embodiment of the invention.
Figure 8:
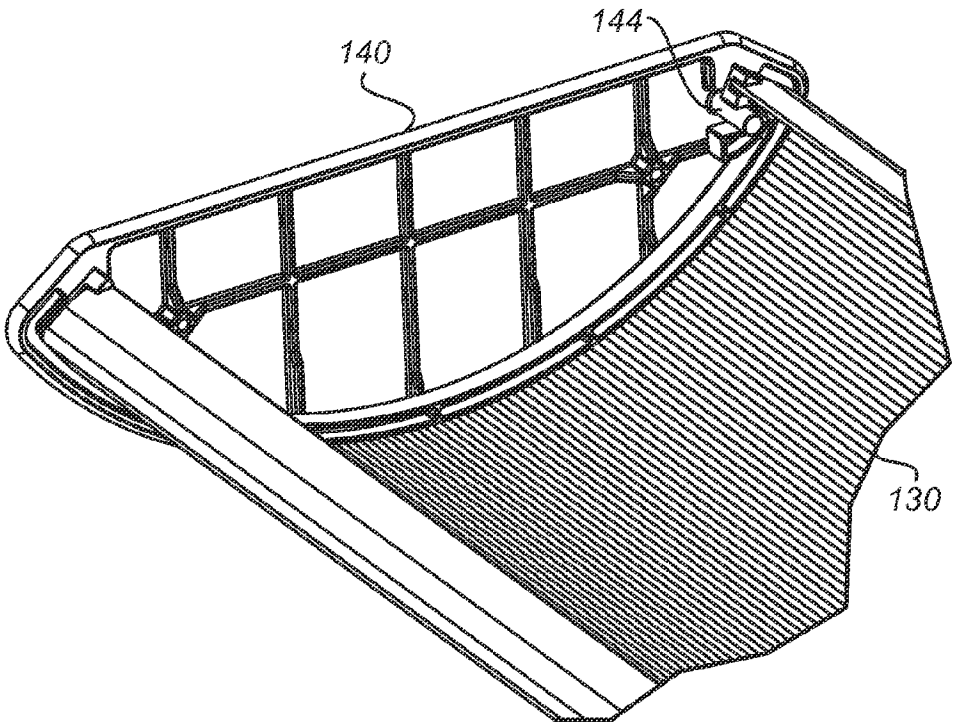
FIG. 8 is a top partial perspective view of one embodiment of the invention.
Figure 9:
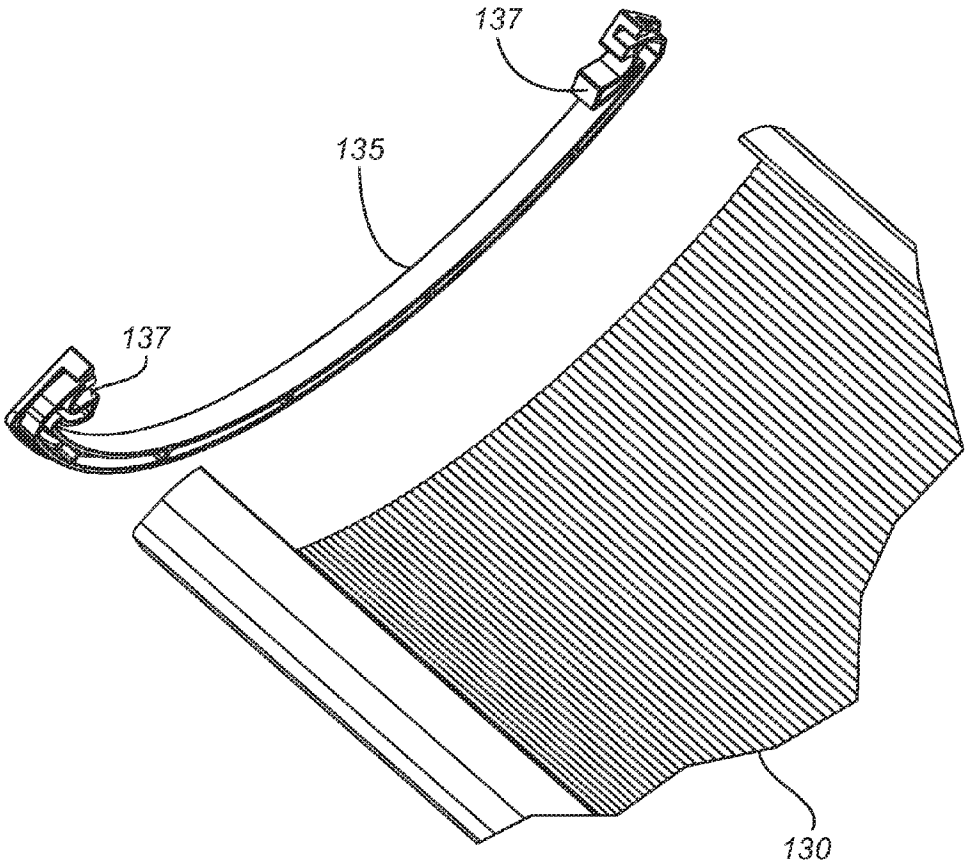
FIG. 9 is a top partial perspective view of an embodiment of the invention.
Figure 10:
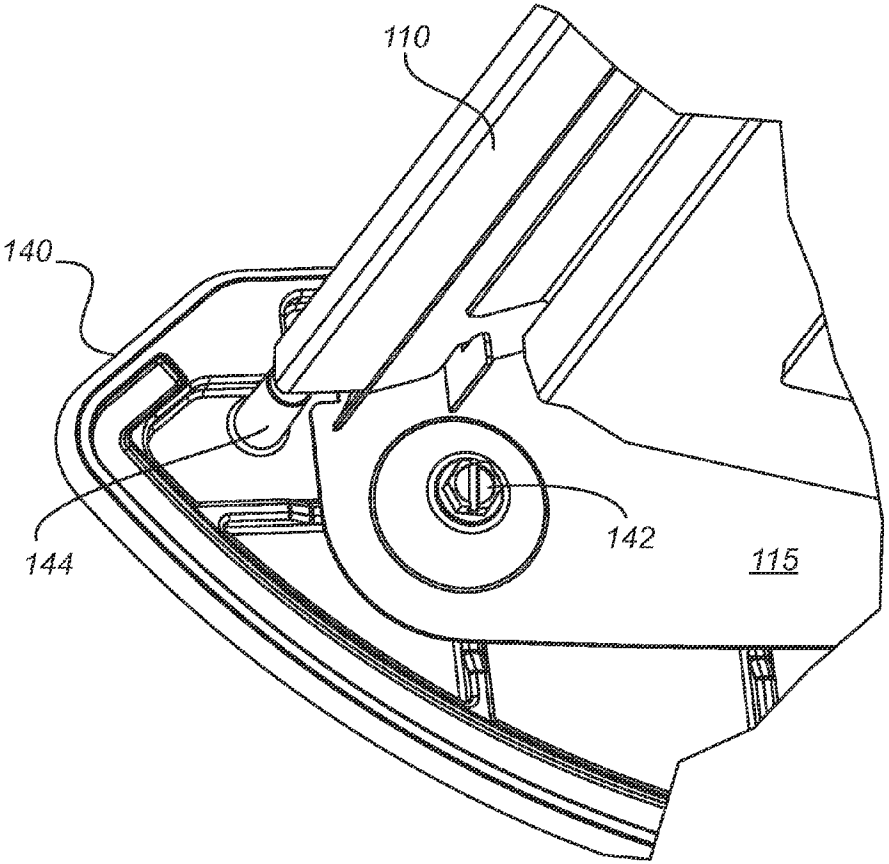
FIG. 10 is a bottom partial perspective view of one embodiment of the invention.
Figure 11:
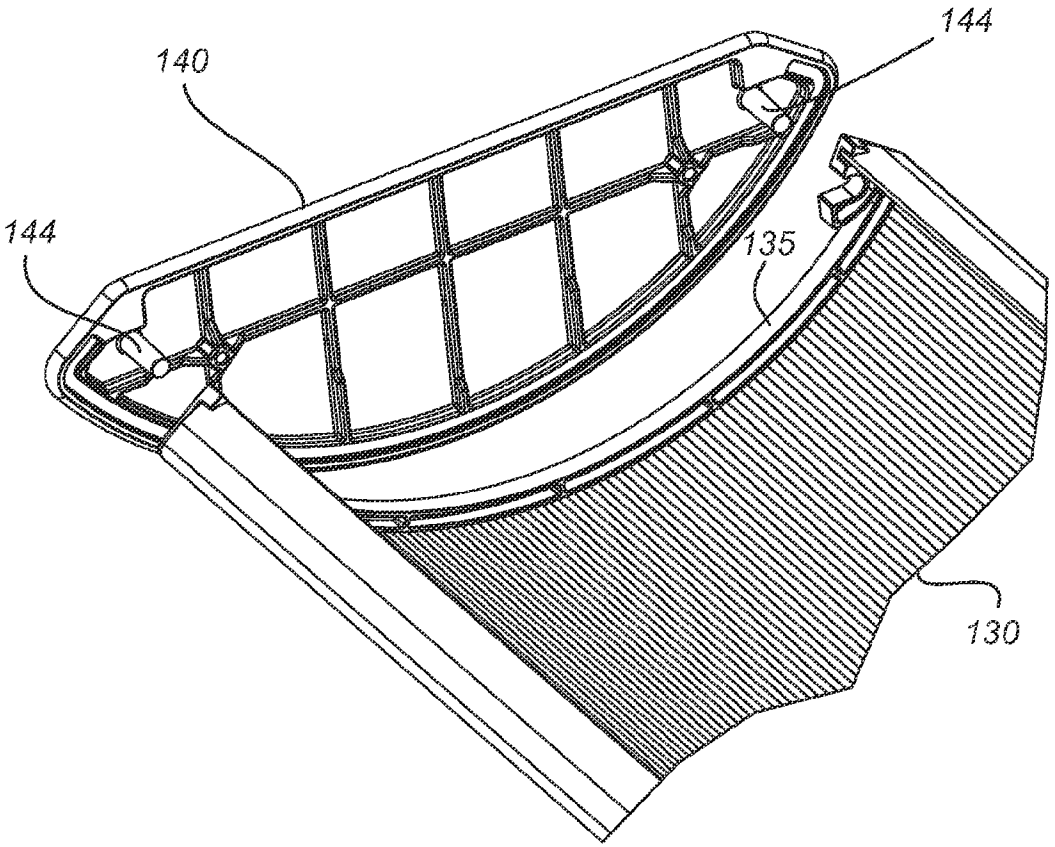
FIG. 11 is a top partial perspective view of an embodiment of the invention.
Figure 12:
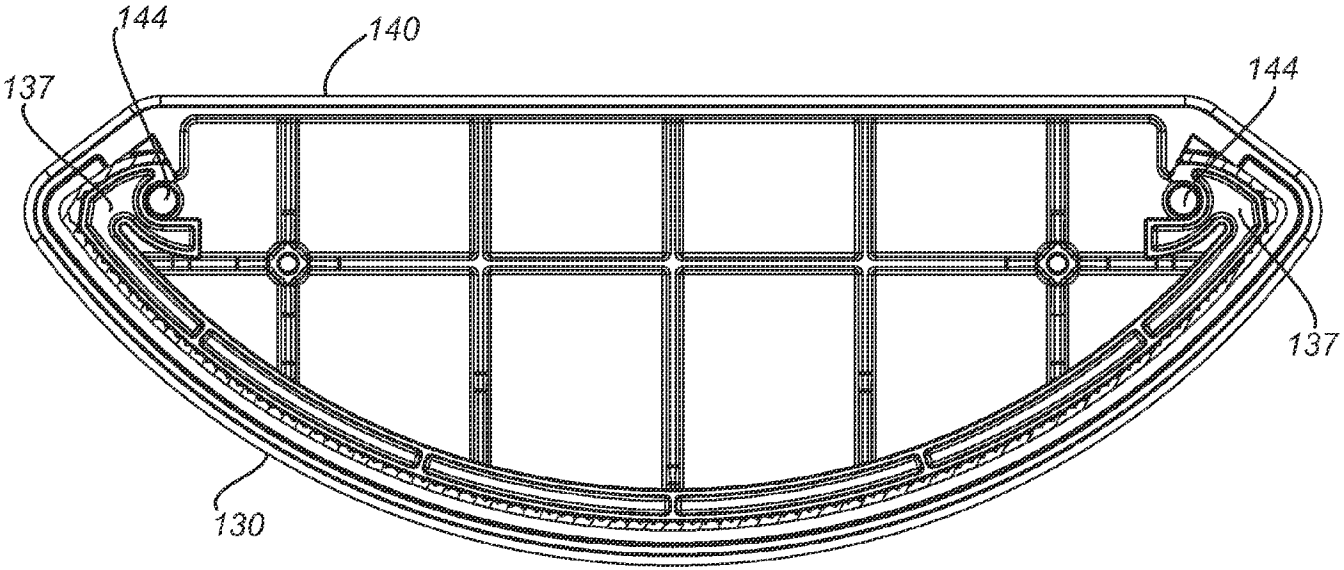
FIG. 12 is an end cross-section view of one embodiment of the invention.

In a traditional fluorescent ceiling mount fixture, fluorescent lamps 120 are mounted on lamp sockets 122 located at each end of the channel 110 so as to extend along the length of the fixture 100 adjacent the channel cover. In one embodiment, LEDs are used instead of fluorescent lamps. In such embodiments where the light source for the fixture 100 includes LEDs 125, the channel cover 150 may have a "V" or other similar shape, as illustrated in FIGS. 3, 6 and 7. The base 165 of the "V" may be located at the center of the channel cover 150 as shown, or in other configurations if desired for alternative light distribution schemes. For example, the base 165 of the "V" may be skewed towards one side of the channel cover 150, so that one side of the channel cover 150 is longer than the other, which would move the centerline of the LEDs, and the concentration of light emitted by the LEDs, away from the actual center of the channel cover 150.

The LEDs 125 and associated printed circuit boards (PCBs) 170 may be mounted to the channel cover 150 on each side of the "V". The "V" shaped configuration thus allows for LEDs 125 on opposite sides of the "V" to have overlapping cone angles β of light emitted from the LEDs 125. FIG. 7 illustrates an exemplary overlap of LED 125 cone angles β, with each LED having a cone angle β of approximately 120 degrees that overlap in the center of the diffuser 130 to prevent a dark shadow from arising along the center of the diffuser. It will be recognized that the LED 125 cone angle β may be adjusted by selecting different LED configurations, such that the LED 125 cone angle β may vary from a very narrow angle (e.g., almost zero degrees or a point source of light) to a very large angle (e.g., up to approximately 200 degrees).

FIG. 7 shows the "V" of the channel cover 150 having an internal angle Θ of approximately 150 degrees, such that each side of the "V" is approximately 15 degrees from the horizontal. The "V" may incorporate other angles, however, as desired for alternative light distribution schemes. In some embodiments, each side of the "V" may be from about 5 to about 40 degrees from horizontal (i.e., the "V" has an internal angle Θ of about 170 degrees to about 100 degrees). In other embodiments, each side of the "V" may be from about 10 to about 30 degrees from horizontal (i.e., the "V" has an internal angle Θ of about 160 degrees to about 120 degrees). In certain embodiments, each side of the "V" may be from about 15 to about 20 degrees from horizontal (i.e., the "V" has an internal angle Θ of about 150 degrees to about 140 degrees).

With reference to FIGS. 2, 3 and 8-12, a diffuser 130 is positioned over the channel 110, and light from the light source (fluorescent lamps 120 or LEDs 125) passes through the diffuser 130 and into the area to be illuminated. End caps 140 are provided to enclose the ends of the fixture 100 and impart a polished appearance to it.

The diffuser 130 may be formed of a translucent material such as a polymeric material. In certain embodiments, such as when used in LED fixtures, the diffuser may include a diffusing film applied to the diffuser to soften the light from the LEDs. Exemplary, though not limiting, types of diffusers include prismatic, smooth and frosted diffusers. In some embodiments, the diffuser 130 is retained on the fixture 100 by diffuser end plates 135 (located on each end of the diffuser 130) engaging end caps 140, as discussed below. In some embodiments, the diffuser end plates 135 are provided only on the ends of the diffuser 130 (i.e., they do not extend along the entire length of the diffuser). In one embodiment illustrated in FIG. 9, the diffuser 130 is curved, and the diffuser end plates 135 are similarly curved to conform to the shape of the end of the diffuser 130.

The diffuser end plate 135 may be formed from known lighting fixture materials, including but not limited to a polymeric, aluminum, steel or non-ferrous metal material. The diffuser end plates 135 may be connected to the diffuser 130 by known methods, including but not limited to sonic welding and adhesives. The diffuser end plates 135 may also be integrally formed with the diffuser 130. In the embodiment shown in FIGS. 8-12, the diffuser end plate 135 is a polymeric material and is sonically welded to the diffuser 130. In other embodiments, the diffuser end plate may snap onto the diffuser or be otherwise configured to attach to the diffuser 130.

As mentioned, the diffuser 130 (and diffuser end plates 135 connected thereto) are retained on the fixture by end caps 140. An exemplary end cap 140 and its interaction with a diffuser end plate 135 is shown in FIGS. 8 and 10-12. The end cap 140 is typically affixed to an end panel 115 connected to the channel 110 with one or more fasteners, such a screw 142. In one embodiment, a pin 144 is provided on each side of each end cap 140. A hook-like structure 137 is similarly provided on each side of each diffuser end plate 135.

To install the diffuser end plates 135—and the diffuser 130 which is attached thereto—to the end caps 140, the hook-like structure 137 provided on one side of each diffuser end plate 135 is positioned on the pin 144 on one side of each end cap 140. The diffuser 130 is then rotated towards the other side of the fixture 100 and the hook-like structure 137 on the opposing side of each diffuser end plate 135 is hooked on the other pin 144 on each of the end caps 140. In other words, the diffuser end plates 135 are snapped onto the end caps 140 of the fixture 100 via hook and pin engagement to thereby retain the diffuser 130 on the fixture 100. The diffuser 130 is thus attached to the fixture 100 at the ends of the diffuser 130. Moreover, the hook-like structure 137 on either side of the diffuser end plate 135 may be disengaged from its associated pin 144 thereby creating a bi-direction hinge in that the diffuser 130 may be disengaged and rotated about the pins 144 on either side of the diffuser end plates 135 for easy access into the fixture.

Although the diffuser end plate 135 is shown in the figures as having two hook-like structures 137 and the end cap 140 as having two pins 144, in certain embodiments each diffuser end plate may have only one hook-like structure and its associated end cap may have only one pin for engaging the hook-like structure. In such embodiments, one side of the diffuser end plate may be screwed, bolted or otherwise attached a side of the end cap, while the other side of the diffuser end plate may include the hook-like structure for engaging a pin on the end cap. It will be recognized that in such an embodiment, the diffuser would only hinge in one direction, and only by removing the screw/bolt/etc. from the side of the diffuser end plate.

It will be recognized that the pins 144 need not necessarily be located on the end caps 140; rather, the pins 144 may be configured to extend directly from the channel 110 and engage the hook-like structures 137 on the diffuser end plate 135. In such an embodiment (not shown), the diffuser end plate would thus be directly connected to the channel 110.

In other embodiments (not shown), the location of the hook-like structures 137 and pins 144 can be reversed such that the hook-like structures 137 are located on the end caps 140 (or channel 110 as described above) and the pins 144 are located on the diffuser end plate 135. In such embodiments, the diffuser 130 could still hinge relative to the channel, with the pins on the diffuser end plate 135 rotating within the hook-like structures 144 located on the end cap 140 or channel 110.

Figure 14:
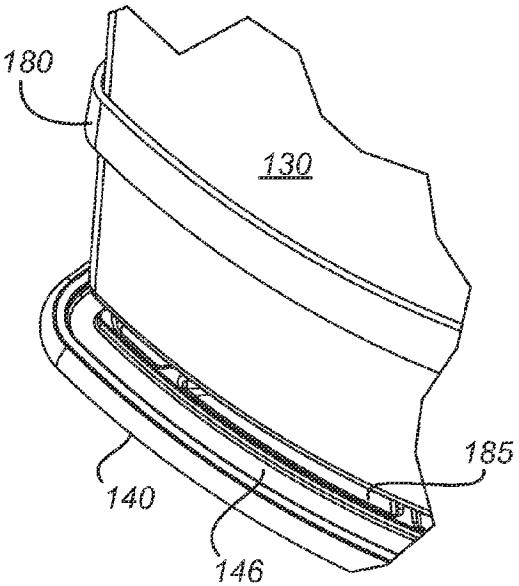
FIG. 14 is a bottom partial perspective view of one embodiment of the invention.
Figure 13:
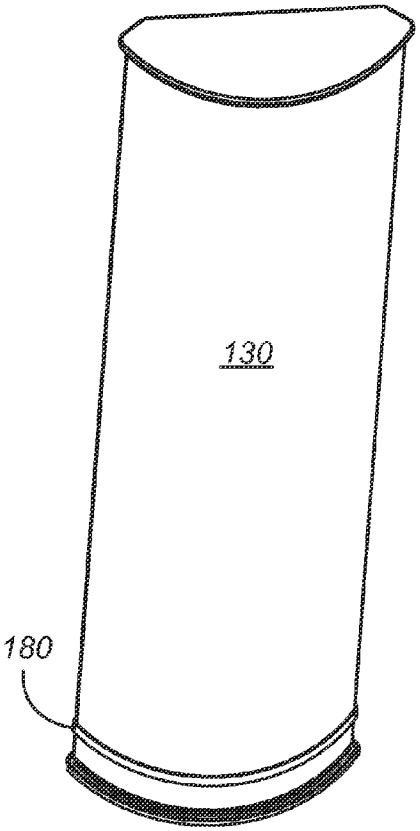
FIG. 13 is a bottom perspective view of an embodiment of the invention.

With reference to FIGS. 13 and 14, in some embodiments strips 180 of material are positioned around the diffuser 130. The strip 180 may be formed of any suitable material, including polymeric materials such as acrylic. In other embodiments the strip may be formed from steel or aluminum. The strips 180 are moveable along the length of the diffuser 130. Once the end caps 140 are positioned on the ends of the fixture 100, and the diffuser 130 is installed, each strip 180 of material is slid towards, and partially received in, one of the end caps 140. Specifically, the end caps 140 may include a groove 146 into which the strip 180 may slide. In this way, the strips 180 span the gap 185 between the diffuser 130 and the end cap 140, thereby preventing light from escaping through the gap 185 (i.e., serving as a light trap) and also helping to prevent the diffuser 130 from disengaging from the fixture 100 (i.e., serving as an additional support to hold the diffuser 130 within the groove 146 of the end cap 140).

In certain embodiments, the strip 180, as installed on the diffuser 130, may have a smaller radius than the diffuser 130, resulting in a tight fit between the strip 180 and the diffuser 130. In this manner, the strip 180 remains securely installed on the diffuser 130 with the ability to slide along the length of the diffuser 130. With the diffuser 130 installed and the strip 180 properly seated within the groove 146 in the end cap 140, length changes of the diffuser 130 due to normal temperature variations should not be great enough for the strip 180 to fully disengage from the groove 146 in the end cap 140, maintaining the light-trapping and securing properties discussed above. The strip 180 thus compensates for manufacturing tolerances and normal thermal expansion of the diffuser 130.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A ceiling mount lighting fixture comprising:

a channel;

a channel cover;

a light source comprising a plurality of light-emitting diodes;

a diffuser comprising a first diffuser end plate located on a first end of the diffuser and a second diffuser end plate located on a second end of the diffuser opposite the first end; and a first end cap mounted on a first end of the channel and a second end cap mounted on a second end of the channel opposite the first end, wherein the channel cover comprises a first side and a second side that intersect in a V-shaped base, wherein at least one of the plurality of light-emitting diodes is mounted on the first side of the channel cover and at least another of the plurality of light-emitting diodes is mounted on the second side of the channel cover, wherein the plurality of light-emitting diodes mounted on the channel cover emit light at cone angles that overlap at the base of the channel cover, and wherein one of the first diffuser end plate and the first end cap comprises at least one pin and the other of the first diffuser end plate and the first end cap comprises at least one hook-like structure that engages the at least one pin of the one of the first diffuser end plate and the first end cap.

2. The ceiling mount lighting fixture of claim 1, wherein the plurality of light-emitting diodes emit light at a cone angle of approximately 120 degrees.

3. The ceiling mount lighting fixture of claim 1, wherein the V-shaped base comprises an internal angle defined by an angle between the first side and second side, and the internal angle is from about 170 to about 100 degrees.

4. The ceiling mount fixture of claim 3, wherein the internal angle is from about 150 degrees to about 140 degrees.

5. The ceiling mount lighting fixture of claim 1, wherein one of the second diffuser end plate and the second end cap comprises at least one pin and the other of the second diffuser end plate and the second end cap comprises at least one hook-like structure that engages the at least one pin of the one of the second diffuser end plate and the second end cap.

6. The ceiling mount lighting fixture of claim 1, wherein:

one of the channel cover and channel comprises at least one tab extending therefrom, wherein the tab comprises a distal portion and a proximal portion narrower than the distal portion;

the other of the channel and channel cover comprises at least one T-slot for receiving the tab, wherein the T-slot comprises a wider portion and a narrower portion; and the tab is movable within the T-slot from a first position in which the distal portion of the tab may pass through the wider portion of the T-slot to a second position in which the tab is retained in the T-slot by the narrower portion of the T-slot, such that the channel cover is retained by the channel.

7. A ceiling mount lighting fixture comprising:

a channel;

a channel cover;

a light source comprising a plurality of light-emitting diodes;

a diffuser;

a first end cap positioned on a first end of the channel and a second end cap positioned on a second end of the channel opposite the first end, wherein each end cap comprises a groove; and a first strip and a second strip located on the diffuser, wherein the first strip is moveable from a first position on the diffuser a distance from the first end cap to a second position in which the first strip engages the groove on the first end cap, and the second strip is moveable from a third position on the diffuser a distance from the second end cap to a fourth position in which the second strip engages the groove on the second end cap, wherein the channel cover comprises a first side and a second side that intersect in a V-shaped base, wherein at least one of the plurality of light-emitting diodes is mounted on the first side of the channel cover and at least another of the plurality of light-emitting diodes is mounted on the second side of the channel cover, wherein the plurality of light-emitting diodes mounted on the channel cover emit light at cone angles that overlap at the base of the channel cover.

8. A ceiling mount lighting fixture comprising:

a channel having two ends;

a light source;

a diffuser;

an end cap positioned on each end of the channel, wherein each end cap comprises a groove; and a plurality of strips located on the diffuser, each strip moveable from a first position on the diffuser a distance from the end caps to a second position in which the strip engages the groove on one of the end caps.

9. The ceiling mount lighting fixture of claim 8, further comprising a channel cover, wherein:

one of the channel cover and channel comprises at least one tab extending therefrom, wherein the tab comprises a distal portion and a proximal portion narrower than the distal portion;

the other of the channel and channel cover comprises at least one T-slot for receiving the tab, wherein the T-slot comprises a wider portion and a narrower portion; and the tab is movable within the T-slot from a first position in which the distal portion of the tab may pass through the wider portion of the T-slot to a second position in which the tab is retained in the T-slot by the narrower portion of the T-slot.

10. The ceiling mount lighting fixture of claim 8, the diffuser comprising a first diffuser end plate located on a first end of the diffuser and a second diffuser end plate located on a second end of the diffuser opposite the first end, and the end caps comprise a first end cap and a second end cap, wherein one of the first diffuser end plate and the first end cap comprises at least one pin and the other of the first diffuser end plate and the first end cap comprises at least one hook-like structure that engages the at least one pin of the one of the first diffuser end plate and the first end cap.

11. The ceiling mount lighting fixture of claim 10, wherein one of the second diffuser end plate and the second end cap comprises at least one pin and the other of the second diffuser end plate and the second end cap comprises at least one hook-like structure that engages the at least one pin of the one of the second diffuser end plate and the second end cap.

12. The ceiling mount lighting fixture of claim 8, the diffuser comprising a first diffuser end plate located on a first end of the diffuser and a second diffuser end plate located on a second end of the diffuser opposite the first end, and the end caps comprise a first end cap and a second end cap, wherein the first diffuser end plate comprises a first hook-like structure, the second diffuser end plate comprises a second hook-like structure, the first end cap comprises a first pin and the second end cap comprises a second pin, and wherein the first pin on the first end cap engages the first hook-like structure on the first diffuser end plate, and the second pin on the second end cap engages the second hook-like structure on the second diffuser end plate, such that the diffuser is retained by the channel and rotatable about the first pin and second pin.

13. A ceiling mount lighting fixture, comprising:

a channel having a first end and a second end;

a channel cover;

a light source comprising a plurality of light-emitting diodes;

a diffuser comprising a first diffuser end plate located on a first end of the diffuser and a second diffuser end plate located on a second end of the diffuser opposite the first end;

a first end cap mounted on a first end of the channel and a second end cap mounted on a second end of the channel opposite the first end, each of the first end cap and second end cap comprising a groove; and a first strip and a second strip located on the diffuser, wherein the first strip is moveable from a first position on the diffuser a distance from the first end cap to a second position in which the first strip engages the groove on the first end cap, and the second strip is moveable from a third position on the diffuser a distance from the second end cap to a fourth position in which the second strip engages the groove on the second end cap, wherein one of the channel cover and channel comprises at least one tab extending therefrom, the tab comprises a distal portion and a proximal portion narrower than the distal portion, the other of the channel and channel cover comprises at least one T-slot for receiving the tab, the T-slot comprises a wider portion and a narrower portion, and the tab is movable within the T-slot from a first position in which the distal portion of the tab may pass through the wider portion of the T-slot to a second position in which the tab is retained in the T-slot by the narrower portion of the T-slot, wherein one of the first diffuser end plate and the first end cap comprises at least one pin and the other of the first diffuser end plate and the first end cap comprises at least one hook-like structure that engages the at least one pin of the one of the first diffuser end plate and the first end cap, and wherein the channel cover comprises a first side and a second side that intersect in a V-shaped base, at least one of the plurality of light-emitting diodes is mounted on the first side of the channel cover and at least another of the plurality of light-emitting diodes is mounted on the second side of the channel cover, and the plurality of light-emitting diodes mounted on the channel cover emit light at cone angles that overlap at the base of the channel cover.

14. The ceiling mount lighting fixture of claim 13, wherein the first diffuser end plate comprises a first hook-like structure, the second diffuser end plate comprises a second hook-like structure, the first end cap comprises a first pin and the second end cap comprises a second pin, and wherein the first pin on the first end cap engages the first hook-like structure on the first diffuser end plate, and the second pin on the second end cap engages the second hook-like structure on the second diffuser end plate, such that the diffuser is retained by the channel and rotatable about the first pin and second pin.

15. The ceiling mount lighting fixture of claim 13, wherein the plurality of light-emitting diodes emit light at a cone angle of approximately 120 degrees.

16. The ceiling mount lighting fixture of claim 13, wherein the V-shaped base comprises an internal angle defined by an angle between the first side and second side, and the internal angle is from about 170 to about 100 degrees.

17. The ceiling mount fixture of claim 16, wherein the internal angle is from about 150 degrees to about 140 degrees.

* * * * *